US009702061B2

(12) United States Patent
Anahara et al.

(10) Patent No.: US 9,702,061 B2
(45) Date of Patent: Jul. 11, 2017

(54) METHOD FOR MANUFACTURING PILE FABRIC

(71) Applicant: KANEKA CORPORATION, Osaka-shi, Osaka (JP)

(72) Inventors: Masaru Anahara, Hyogo (JP); Sohei Nishida, Osaka (JP)

(73) Assignee: Kaneka Corporation, Osaka (JP)

( * ) Notice: Subject to any disclaimer, the term of this patent is extended or adjusted under 35 U.S.C. 154(b) by 171 days.

(21) Appl. No.: 14/430,072

(22) PCT Filed: Sep. 18, 2013

(86) PCT No.: PCT/JP2013/075115
§ 371 (c)(1),
(2) Date: Mar. 20, 2015

(87) PCT Pub. No.: WO2014/046110
PCT Pub. Date: Mar. 27, 2014

(65) Prior Publication Data

US 2015/0240386 A1 Aug. 27, 2015

(30) Foreign Application Priority Data

Sep. 24, 2012 (JP) ..... 2012-209438

(51) Int. Cl.

| | |
|---|---|
| ***D06C 11/00*** | (2006.01) |
| ***D01F 1/06*** | (2006.01) |
| ***D06P 5/20*** | (2006.01) |
| ***D06P 5/13*** | (2006.01) |
| ***D03D 27/00*** | (2006.01) |
| ***D04B 1/04*** | (2006.01) |
| ***D01F 6/54*** | (2006.01) |
| ***D01F 6/38*** | (2006.01) |
| ***D01F 6/52*** | (2006.01) |
| *D03D 15/00* | (2006.01) |

(52) U.S. Cl.
CPC ..... *D01F 1/06* (2013.01); *D01F 6/38* (2013.01); *D01F 6/52* (2013.01); *D01F 6/54* (2013.01); *D03D 15/0033* (2013.01); *D03D 27/00* (2013.01); *D04B 1/04* (2013.01); *D06P 5/13* (2013.01); *D06P 5/2077* (2013.01); *D03D 15/00* (2013.01)

(58) Field of Classification Search
CPC .. D01F 6/52; D01F 6/54; D03D 27/00; D04B 1/04; D06C 11/00; D06P 5/13; D06P 5/2077
USPC ..... 264/78, 103, 132, 182, 184, 211.13, 264/211.18, 211.2; 8/457, 494, 497
See application file for complete search history.

(56) References Cited

U.S. PATENT DOCUMENTS

| | | | | |
|---|---|---|---|---|
| 4,788,093 | A | 11/1988 | Murata et al. | |
| 5,436,275 | A | 7/1995 | Kawasaki et al. | |
| 6,821,599 | B1 | 11/2004 | Kuroda et al. | |
| 2007/0243377 | A1 * | 10/2007 | Nishida | D01F 6/54 428/364 |

FOREIGN PATENT DOCUMENTS

| | | | | |
|---|---|---|---|---|
| EP | 0 219 875 | | 4/1987 | |
| EP | 1 270 774 | | 1/2003 | |
| GB | 2 285 009 | | 6/1995 | |
| GB | 2 315 454 | | 2/1998 | |
| JP | 62-078210 | | 4/1987 | |
| JP | 7-150471 | | 6/1995 | |
| JP | 2597090 | B | 4/1997 | |
| JP | 2003013358 | A * | 1/2003 | D03D 27/00 |
| JP | 2004-081283 | | 3/2004 | |
| JP | 2004-129865 | | 4/2004 | |
| JP | 2004339613 | A * | 12/2004 | D06P 5/13 |
| JP | 2005-314841 | | 11/2005 | |
| JP | 2008-013877 | | 1/2008 | |
| JP | 2009-228188 | | 10/2009 | |
| WO | 01/27364 | | 4/2001 | |
| WO | 2011/122016 | | 10/2011 | |

OTHER PUBLICATIONS

Machine translation of JP 2004339613 A (published on Dec. 2, 2004).*

* cited by examiner

*Primary Examiner* — Leo B Tentoni
(74) *Attorney, Agent, or Firm* — Hamre, Schumann, Mueller & Larson, P.C.

(57) ABSTRACT

The present invention relates to a pile fabric including an acrylic synthetic fiber at a napped portion, the acrylic synthetic fiber is obtained by spinning a spinning solution including 90 to 99 parts by weight of a polymer A and 1 to 10 parts by weight of a polymer B. The polymer A is a polymer obtained by polymerizing a composition A including 40 to 97 wt % of acrylonitrile, 0 to 5 wt % of a sulfonic acid-containing monomer and 3 to 60 wt % of another copolymerizable monomer. The polymer B is obtained by polymerizing a composition B including 0 to 70 wt % of acrylonitrile, 20 to 90 wt % of acrylic ester and 10 to 40 wt % of a sulfonic acid-containing monomer, and the polymer B is a polymer to be dissolved in a mixed solvent composed of water and at least one organic solvent selected from the group consisting of N,N-dimethylformamide, N,N-dimethylacetamide, dimethylsulfoxide and acetone. The acrylic synthetic fiber forming the napped portion is dyed or discharge-printed at least partially, and the dyed or discharge-printed acrylic synthetic fiber has an apparent specific gravity in a range of 0.8 to 1.1.

36 Claims, 2 Drawing Sheets

METHOD FOR MANUFACTURING PILE FABRIC

TECHNICAL FIELD

The present invention relates to a pile fabric and a method for manufacturing the same. More specifically, the present invention relates to a pile fabric including an acrylic synthetic fiber at a napped portion, and a method for manufacturing the same.

BACKGROUND ART

Pile fabrics have been used for clothing or the like as they enhance the design of appearance. However, there has been a problem in use of the pile fabric, namely, the garments become undesirably heavy even though the appearance is enhanced.

In order to cope with this problem, porous fibers have been used for the fiber to form the pile fabric. For example, Patent document 1 suggests making fibers porous by subjecting an acrylic fiber prepared by blending a hydrophilic polymer soluble in an organic solvent used for spinning to a wet-heat treatment, and manufacturing a lightweight pile fabric by use of the fiber.

In some cases, the fiber at a napped portion of a pile fabric is dyed for a design. At the time of dyeing, sometimes the fabric is steamed as required. Or a part of the dyestuff fixed to the fiber at the napped portion is degraded and then another dyestuff of a different color may be coated thereon. This method is advantageous since the design at the napped portion of the pile fabric is improved and the appearance more closely resembles to that of animal hair. In general, a step of degrading a part of the dyestuff with a discharging agent is called a "discharging step", and a step of coating a print dyestuff is called a "printing step". During these steps, for the purpose of making the discharging agent and the print dyestuff penetrate into the fibers at the napped portion, a steam treatment is conducted.

PRIOR ART DOCUMENTS

Patent documents

Patent document 1: WO 2011/122016 A1

DISCLOSURE OF INVENTION

Problem to be Solved by the Invention

The inventors found that the pile fabric including a porous fiber as proposed in Patent document 1 raises a problem. That is, due to the steam treatment at the time of dyeing or discharge-printing treatment, voids in the fibers disappear, and thus the lightness and the voluminousness would be impaired.

For solving the above-described problem, the present invention provides a pile fabric that is excellent in design and also excellent in lightness and voluminousness, and also a method for manufacturing the pile fabric.

Means for Solving Problem

A pile fabric of the present invention is a pile fabric comprising an acrylic synthetic fiber at a napped portion. The acrylic synthetic fiber is a fiber obtained by spinning a spinning solution comprising a polymer A and a polymer B.

When the total weight of the polymer A and the polymer B in the spinning solution is 100 parts by weight, the polymer A is 90 to 99 parts by weight and the polymer B is 1 to 10 parts by weight. The polymer A is a polymer obtained by polymerizing a composition A that is a composition comprising 40 to 97 wt % of acrylonitrile, 0 to 5 wt % of sulfonic acid-containing monomer and 3 to 60 wt % of another copolymerizable monomer when the total weight of the composition A is 100 wt %. The polymer B is a polymer that is obtained by polymerizing a composition B and that dissolves in a mixed solvent composed of water and at least one organic solvent selected from the group consisting of N,N-dimethylformamide, N,N-dimethylacetamide, dimethylsulfoxide and acetone. And the composition B is a composition comprising 0 to 70 wt % of acrylonitrile, 20 to 90 wt % of acrylic ester and 10 to 40 wt % of sulfonic acid-containing monomer when the total weight of the composition B is 100 wt %. The acrylic synthetic fiber that forms the napped portion is dyed or discharge-printed at least partially, and the dyed or discharge-printed acrylic synthetic fiber has an apparent specific gravity in a range of 0.8 to 1.1.

A method for manufacturing a pile fabric of the present invention is a method for manufacturing the above-described pile fabric, and the method comprises: dyeing at least partially the acrylic synthetic fiber before forming the napped portion of the pile fabric or after forming the napped portion of the pile fabric; discharge-printing the pile fabric comprising the dyed acrylic synthetic fiber at the napped portion, as required; adding water in an amount of more than 43 parts by weight with respect to 100 parts by weight of the dyed or discharge-printed acrylic synthetic fiber forming the napped portion of the pile fabric, and carrying out a wet-heat treatment at a temperature higher than 80° C.

Effects of the Invention

According to the present invention, even after a dyeing treatment or a discharge-printing treatment, the voids in the certain acrylic synthetic fiber forming the napped portion of the pile fabric do not disappear, and by making the apparent specific gravity of the acrylic synthetic fiber after a dyeing treatment or a discharge-printing treatment in the range of 0.8 to 1.1, it is possible to provide a pile fabric with excellent design and with excellent lightness and voluminousness, and also a method for producing the same.

DESCRIPTION OF THE INVENTION

Figure 1:
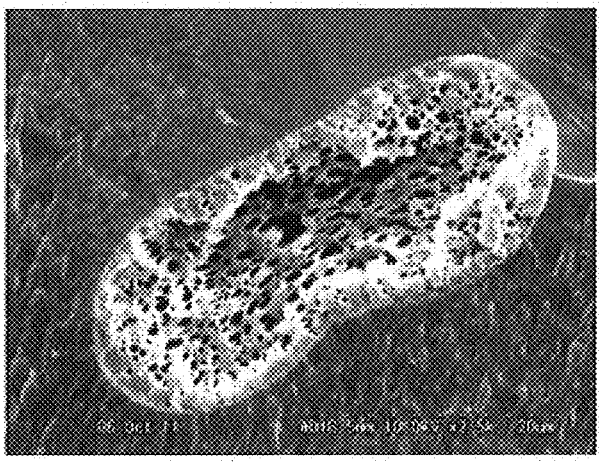
FIG. 1 is a photograph taken with a scanning electron microscope (SEM) to show a cross section of an acrylic synthetic fiber in a pile fabric of Working Example 1.

In the present invention, a dyeing treatment refers to dyeing an acrylic synthetic fiber after spinning. It embraces a case of dyeing the acrylic synthetic fiber in a state of pile fabric and a case of dyeing an acrylic synthetic fiber and then processing to form a pile fabric from the acrylic synthetic fiber. That is, the dyeing treatment of the acrylic synthetic fiber may be carried out before forming the napped portion of the pile fabric, or the dyeing treatment may be carried out after forming the napped portion of the pile fabric. Further in the present invention, a discharge-printing treatment embraces a case including only a discharging step of degrading a part of a dyestuff by using a discharging agent (referred also to as a "white discharge-printing treatment") and a case including the discharging step and a printing step of coating a print dyestuff (referred also to as a "color discharge-printing treatment"). The acrylic synthetic fiber makes a dyed acrylic synthetic fiber through a dyeing treatment, and it makes a discharge-printed acrylic synthetic fiber through a discharge-printing treatment. The discharge-printing treatment is carried out with respect to a fiber dyed through a dyeing treatment, and thus, any fiber subjected to a discharge-printing treatment should have been dyed in advance. Hereinafter, if not indicated otherwise, an acrylic synthetic fiber is a fiber that has not been dyed. Needless to note, it is considered that a fiber that has not been dyed is not discharge-printed.

The inventors have found that in a pile fabric having a napped portion formed of an acrylic synthetic fiber in which voids are developed by use of specific polymer A and polymer B, the voids disappear due to a dyeing or discharge-printing treatment carried out for improving the design. The reason is assumed to be as follows, namely, the acrylic synthetic fiber shrinks due to the dyeing or the discharge-printing treatment, in particular, due to a steaming treatment during the dyeing or discharge-printing treatment. As a result of keen studies for solving this problem, the inventors found that, in a pile fabric having a napped portion formed of a dyed or discharge-printed acrylic synthetic fiber, it is possible to recover the voids by adding water to the acrylic synthetic fiber forming the napped portion and at the same time of carrying out a wet-heat treatment, resulting in the present invention. After carrying out the dyeing treatment or the discharge-printing treatment, the voids can be recovered by adding water to the acrylic synthetic fiber forming the napped portion and at the same time of carrying out the wet-heat treatment. The reason is assumed that the polymer B absorbs water and swells.

A pile fabric of the present invention includes an acrylic synthetic fiber at a napped portion (pile portion). The acrylic synthetic fiber is obtained by spinning a spinning solution including the polymer A and the polymer B. The acrylic synthetic fiber is a porous fiber. The porous fiber can be confirmed by observing the cross section of the acrylic synthetic fiber with a scanning electron microscope (SEM).

In the pile fabric of the present invention, the acrylic synthetic fiber is a porous fiber and preferably it has an apparent specific gravity in a range of 0.8 to 1.1, more preferably 0.8 to 1.0, and further preferably 0.85 to 0.95. When the apparent specific gravity is 0.8 to 1.1, a fiber lightweight and having a certain strength is obtained. When the fiber is applied at the napped portion, a pile fabric that is lightweight, having a high perceived density in appearance and a high bulkiness in touch can be obtained.

The polymer A is a polymer obtained by polymerizing a composition A. When the total weight of the composition A is 100 wt %, the composition A includes 40 to 97 wt % of acrylonitrile, 3 to 60 wt % of another copolymerizable monomer, and 0 to 5 wt % of a sulfonic acid-containing monomer. Further, when the total weight of the composition A is 100 wt %, it is preferable that the composition A includes 40 to 70 wt % of acrylonitrile, 30 to 60 wt % of another copolymerizable monomer, and 0 to 5 wt % of a sulfonic acid-containing monomer.

When the content of the acrylonitrile in the composition A is 40 to 97 wt %, damage caused by the heat of a tenter or a polishing at the time of processing to a pile fabric can be prevented, and the resultant pile fabric has a favorable appearance and touch. Further, when the content of the acrylonitrile in the composition A is 40 to 70 wt %, in addition to the above-described advantages, since the softening point is lowered, the composition will be softened easily during a wet-heat treatment, and thus volume expansion caused by swelling of the polymer B is not hindered and thus void formation will be further facilitated.

In the above-described composition A, there is no particular limitation on the copolymerizable polymer as long as it can be copolymerized with the acrylonitrile. It is possible to use any known vinyl compounds, and the examples include: vinyl halides such as vinyl chloride and vinyl bromide; vinylidene halides such as vinylidene chloride and vinylidene bromide; unsaturated carboxylic acids such as acrylic acid and methacrylic acid and the salts thereof, methacrylic acid esters such as methyl methacrylate, esters of unsaturated carboxylic acids such as glycidyl methacrylate; and vinylesters such as vinyl acetate and vinyl butyrate. These monomers may be used alone, or two or more thereof may be used together. Among them, it is preferable to use halogen-containing monomers such as vinyl halides like vinyl chloride and vinyl bromide, and vinylidene halides like vinylidene chloride and vinylidene bromide. By using the halogen-containing monomers, processability to a pile fabric is improved, and the resultant pile fabric has favorable appearance and touch. Though there is no particular limitation on the halogen-containing monomers, preferred examples include vinyl halides such as vinyl chloride and vinyl bromide, and vinylidene halides such as vinylidene chloride and vinylidene bromide. These monomers may be used alone, or two or more thereof may be used together.

When the content of the other copolymerizable monomer in the composition A is in the range of 3 to 60 wt %, the softening point of the fiber can be lowered, thereby crimps of the pile fiber is easily stretched in the polishing step for processing to a pile fabric, and thus a pile fabric with favorable appearance and touch can be obtained. Further, in addition to that, when the content of the halogen-containing monomer in the composition A is in the range of 30 to 60 wt %, the softening point is lowered further, and thus void formation by the wet-heat treatment can be facilitated further.

In the composition A, though there is no particular limitation, preferred examples of the sulfonic acid-containing monomer include allylsulfonic acid, methallylsulfonic acid, styrenesulfonic acid, isoprene sulfonic acid, 2-acrylamide-2-methylpropanesulfonic acid, and metal salts such as sodium salts thereof and their amine salts. These monomers may be used alone, or two or more thereof may be used together. When the composition A contains the sulfonic acid-containing monomer, dye-affinity of the fiber can be improved. On the other hand, when the content of the sulfonic acid-containing monomer in the composition A exceeds 5 wt %, there may be a risk of agglutination in the fibers.

The polymer B is a polymer obtained by polymerizing a composition B. When the total weight of the composition B is 100 wt %, the composition B includes 0 to 70 wt % of acrylonitrile, 20 to 90 wt % of acrylic ester, and 10 to 40 wt % of a sulfonic acid-containing monomer. When the content of the acrylonitrile in the composition B is 70 wt % or less, the polymer B has a high hydrophilicity and an appropriate softening point, and thus the polymer B swells easily during a wet-heat treatment, and voids are developed easily.

In the above-described composition B, examples of the acrylic ester include methyl acrylate, ethyl acrylate, butyl acrylate, isobutyl acrylate, sec-butyl acrylate, tert-butyl acrylate, amyl acrylate, isoamyl acrylate, hexyl acrylate, cyclohexyl acrylate, heptyl acrylate, octyl acrylate, isooctyl acrylate, and 2-ethylhexyl acrylate. These acrylic esters may be used alone, or two or more thereof may be used together. Among them, from the viewpoint of improving the polymerization property and also lowering the softening point of the polymer B so as to develop voids more easily during the wet-heat treatment, it is preferable that the acrylic ester is at least one selected from the group consisting of methyl acrylate, ethyl acrylate and butyl acrylate. If the composition B contains 20 to 90 wt % of the acrylic ester, the softening point of the polymer B is lowered, and thus the voids can be developed easily during the wet-heat treatment.

In the composition B, though there is no particular limitation, preferred examples of the sulfonic acid-containing monomer include allylsulfonic acid, methallylsulfonic acid, styrenesulfonic acid, isoprene sulfonic acid, 2-acrylamide-2-methylpropanesulfonic acid, and metal salts such as sodium salts thereof and their amine salts. These monomers may be used alone, or two or more thereof may be used together. Among them, from the viewpoint of improving the color development, it is preferable to use a mixture of sodium 2-acrylamido-2-methylpropanesulfonate and sodium methallylsulfonate. When the content of the sulfonic acid-containing monomer in the composition B is in the range of 10 to 40 wt %, hydrophilicity of the polymer B is improved and the polymer B swells easily with water, and thus voids are developed easily during a wet-heat treatment. When the content of the sulfonic acid-containing monomer in the composition B is 10 wt % or more, the polymer B has an enhanced hydrophilicity and thus it swells easily with water. Further, when the content of the sulfonic acid-containing monomer in the composition B is 40 wt % or less, a phase separation of the polymer B from the polymer A does not occur, and thus the fiber strength does not deteriorate.

The polymer B is a polymer that dissolves in a mixed solvent composed of water and at least one organic solvent selected from the group consisting of N,N-dimethyl formamide (DMF), N,N-dimethylacetamide (DMA), dimethyl sulfoxide (DMSO) and acetone. When the total weight of the mixed solvent is 100 wt %, it is preferable that the mixed solvent includes 0 to 30 wt % of water and 70 to 100 wt % of at least one organic solvent selected from the group consisting of DMF, DMA, DMSO and acetone; and more preferably, it includes 5 to 25 wt % of water and 75 to 95 wt % of at least one organic solvent selected from the group consisting of DMF, DMA, DMSO and acetone. Further, it is preferable that the polymer B dissolves at 40° C. at a concentration of 1 wt % or more in a mixed solvent composed of 20 wt % of distilled water and 80 wt % of at least one organic solvent selected from the group consisting of DMF, DMA, DMSO and acetone. The polymer B dissolves in a mixed solvent of water and at least one organic solvent selected from the group consisting of DMF, DMA, DMSO and acetone, the spinnability is improved, and dropping of the polymer B from fibers does not occur, and thus an acrylic synthetic fiber having a smooth surface and a soft texture can be obtained. And it is preferable that the polymer B dissolves in the mixed solvent at 40° C. at a concentration of 10 wt % or higher, more preferably at a concentration of 20 wt % or higher, and further preferably at a concentration of 30 wt % or higher. Thereby, the spinnability is improved further, and dropping of the polymer B from fibers does not occur, and thus an acrylic synthetic fiber having a smooth surface and a softer texture can be obtained.

From the viewpoint of productivity, it is more preferable that the above-described mixed solvent is a mixture of water and acetone. It is preferable that when the total weight of the mixed solvent is 100 wt %, the mixed solvent includes 0 to 30 wt % of water and 70 to 100 wt % of acetone, and more preferably, 5 to 25 wt % of water and 75 to 95 wt % of acetone. And it is preferable that the polymer B dissolves at 40° C. at a concentration of 1 wt % or higher in a mixed solvent composed of 20 wt % of distilled water and 80 wt % of acetone.

For the polymer B, for example, polymers of the compositions as described below can be used:

(1) a polymer obtained by polymerizing a composition B composed of 15 wt % of acrylonitrile, 54 wt % of methyl acrylate, 30 wt % of sodium 2-acrylamido-2-methylpropanesulfonate, and 1 wt % of sodium methallylsulfonate;
(2) a polymer obtained by polymerizing a composition B composed of 15 wt % of acrylonitrile, 54.75 wt % of methyl acrylate, 30 wt % of sodium 2-acrylamido-2-methylpropanesulfonate, and 0.25 wt % of sodium methallylsulfonate;
(3) a polymer obtained by polymerizing a composition B composed of 50 wt % of acrylonitrile, 30 wt % of methyl acrylate, and 20 wt % of sodium 2-acrylamido-2-methylpropanesulfonate.

The polymers B in the above (1) to (3) are preferred since they dissolve at 40° C. at a concentration of 10 wt % or higher in a mixed solvent composed of 20 wt % of distilled water and 80 wt % of N,N-dimethyl formamide, N,N-dimethylacetamide, dimethyl sulfoxide or acetone, and furthermore, since they are incompatible with the polymer A, highly hydrophilic and thus swell easily with water.

Though there is no particular limitation, the polymer A and the polymer B can be obtained using any known compounds as initiators such as peroxide compounds, azo compounds or various redox compounds by a regular polymerization method such as emulsion polymerization, suspension polymerization or solution polymerization.

The polymer A and polymer B are dissolved in an organic solvent used for spinning, more specifically, an organic solvent like acetone, N,N-dimethyl formamide, N,N-dimethylacetamide, dimethyl sulfoxide or the like so as to prepare a spinning solution. To this spinning solution, an inorganic and/or organic pigment such as titanium oxide or coloring pigments, a stabilizing agent effective in rust prevention, coloring and spinning or weatherability or the like also can be added as long as it does not impair the spinning.

In a case where the total weight of the polymer A and the polymer B in the spinning solution is 100 parts by weight, the polymer A is in a range of 90 to 99 parts by weight and the polymer B is in a range of 1 to 10 parts by weight. If the polymer B is 1 to 10 parts by weight, during a wet-heat treatment, the polymer B swells by the humidity and heat thereby developing voids, and thus a fiber having an apparent specific gravity of 0.8 to 1.1 is obtained. If the content of the polymer B is 1 part by weight or more, the polymer B swells to develop voids easily during the wet-heat treatment, and thus the apparent specific gravity of the fiber will be 1.1 or lower easily. And if the polymer B is 10 parts by weight or less, a phase separation between the polymer A and the polymer B does not occur, and the fiber strength does not deteriorate.

The acrylic synthetic fiber can be manufactured by spinning the spinning solution obtained by dissolving the polymer A and the polymer B in an organic solvent used for spinning, and later carrying out a wet-heat treatment. The fiber is spun from a nozzle by a regular wet or dry spinning and then drawn and dried. It may be further drawn and heat-treated as required. It is preferable that a heat treatment is not carried out after drawing, since a fiber without being heated has excellent flexibility and it is softened easily during a wet-heat treatment and voids are developed easily. Here, it is preferable that the wet-heat treatment is carried out at a temperature equal to or higher than the softening points of the polymer A and the polymer B, more preferably at a temperature in a range of 90 to 130° C., and further preferably 100 to 120° C. If the temperature for the wet-heat treatment is low, the voids would be hardly formed and thus, it might be difficult to provide an apparent specific gravity of 1.1 or less. On the other hand, if the temperature for the wet-heat treatment is high, the fiber would stick and thus processing to a pile fabric would be difficult. Moreover, the resultant pile fabric may have inferior appearance and touch. The wet-heat treatment may be carried out for example by treating in warm water. In a case of dyeing a fiber, the dyeing may be carried out at the same time as the wet-heat treatment or after the wet-heat treatment. There is no particular limitation on the dyeing, and for example, it can be carried out by using a cationic dye for discharge-printing or the like in a manner similar to the case of an ordinary dyeing of an acrylic synthetic fiber.

In the pile fabric of the present invention, the acrylic synthetic fiber is used as a pile fiber for forming a napped portion (pile portion). It is preferable that the content of the acrylic synthetic fiber in the pile fiber is 50 wt % or more, more preferably 80 wt % or more, and further preferably 100 wt %. The resultant pile fabric is lightweight, having a soft touch and favorable voluminousness, namely it has a high perceived density in appearance and a high bulkiness in touch.

Though there is no particular limitation, it is more preferable that the acrylic synthetic fiber has a fineness in a range of 0.5 to 70 dtex, and further preferably 1 to 50 dtex, from the viewpoint of providing a favorable pile processability.

In the pile fabric, the acrylic synthetic fiber forming the napped portion is dyed or discharge-printed at least partially. Preferably, the acrylic synthetic fiber forming the napped portion is dyed or discharge-printed entirely. Thereby, the surface of the pile fabric (napped portion) exhibits two or more colors and thus the design is improved and the appearance will be similar to that of animal hair. From the viewpoint of providing an excellent design and an appearance similar to that of animal hair, it is preferable that the acrylic synthetic fiber forming the napped portion is dyed or discharge-printed, and it is more preferable that the acrylic synthetic fiber forming the napped portion is color discharge-printed. As a result of dyeing or discharge-printing, the acrylic synthetic fiber forming the napped portion can exhibit different colors between the top and the root, resulting in an excellent design.

In the pile fabric, the dyed or discharge-printed acrylic synthetic fiber is a porous fiber having an apparent specific gravity in a range of 0.8 to 1.1. From the viewpoint of improving the lightness, it is preferable that the apparent specific gravity is in a range of 0.8 to 1.0.

The pile fabric may be a high pile or a boa pile. A high pile can raise the productivity and thus an article with excellent design can be produced. A boa pile can suppress fall of its standing fibers, and it can be applied to a lining of a garment or home furnishing.

Though there is no particular limitation, from the viewpoint of the visually perceived density and the voluminousness in touch, it is preferable that the weight per square-meter of the pile fabric is in a range of 100 to 1500 g/m$^2$, and more preferably 450 to 1000 g/m$^2$.

Hereinafter a method for manufacturing a pile fabric of the present invention will be described.

First, the acrylic synthetic fiber is used for a pile fiber so as to produce a pile fabric such as a high pile or boa pile in an ordinary method. For the acrylic synthetic fiber, a fiber dyed with a cationic dye is used preferably. Alternatively, it is also possible to produce a pile fabric and then the acrylic synthetic fiber is dyed with a cationic dye. For the cationic dye, for example, a yellow cationic dye, a red cationic dye, a blue cationic dye and the like can be used. For the yellow cationic dye, for example, Aizen Cathilon Discharge Yellow NLH (manufactured by Hodogaya Chemical Co., Ltd.) and the like can be used. For the red cationic dye, for example, Aizen Cathilon Red CD-FGLH (manufactured by Hodogaya Chemical Co., Ltd.) and the like can be used. For the blue cationic dye, for example, Astrazon Blue FGGL (manufactured by Dystar Japan Ltd.) and the like can be used. It is preferable that the dyeing treatment is carried out at 90 to 105° C. for 30 minutes or longer. Preferably the dyeing treatment is carried out in a dyebath containing a dyestuff. Steam may be used during the dyeing treatment.

Next, preferably, the resultant pile fabric is discharged and printed. As mentioned above, the discharge-printing treatment may be composed of only a discharging step or may be composed of a discharging step and a printing step. In a case where the discharge-printing treatment is a discharge-printing treatment composed of a discharging step and a printing step, namely, in a case of a color discharge-printing treatment, the acrylic synthetic fiber will be discharge-printed and later dyed further.

The discharging step is carried out by, for example, applying a discharge paste including a discharging agent on the surface of the pile fabric (napped portion) and steaming. Though there is no particular limitation, for the discharging agent, for example, a tin-based discharging agent such as stannous chloride and a zinc-based discharging agent such as zinc formaldehyde sulfoxylate are used preferably. It is preferable that the steaming treatment is carried out for example at a temperature in a range of 90 to 110° C. for 0.5 to 2 hours.

In a case of a color discharge-printing treatment, a printing step is carried out further after the discharging step. Specifically, a print dyestuff is applied to a pile fabric that has been subjected to a white discharge-printing treatment and a steaming treatment is carried out. Though there is no particular limitation, it is preferable to use for example, Maxilon Golden Yellow GL (manufactured by Ciba Specialty Chemicals Inc.), Astrazon Brilliant Red 4G (manufactured by Miles (Mobay)), Astrazon Blue F2RL (manufactured by Dystar Japan Ltd.) or the like for the print dyestuff. It is preferable that the steaming treatment is carried out at a temperature in a range of 90 to 110° C. for 0.5 to 2 hours for example.

Next, water is added to the acrylic synthetic fiber forming the napped portion of the pile fabric that has been dyed or discharge-printed as described above so as to carry out a wet-heat treatment. The addition amount of water exceeds 43 parts by weight, preferably 45 parts by weight or more, more preferably 60 parts by weight or more, and further preferably 60 to 200 parts by weight with respect to 100 parts by weight of the dyed or discharge-printed acrylic synthetic fiber that forms the napped portion of the pile fabric. Here, the weight of the acrylic synthetic fiber refers to a weight in a dried state. If the addition amount of water exceeds 43 parts by weight, the voids that have disappeared due to the dyeing or discharge-printing treatment can be restored, and thus a lightweight and voluminous pile fabric can be obtained. And if the addition amount of water is 200 parts by weight or less, favorable workability is realized while achieving the effect of restoring the voids.

The wet-heat treatment is carried out at a temperature higher than 80° C., preferably at a temperature of 85° C. or higher, more preferably at a temperature of 85° C. or higher and lower than 120° C., and further preferably at a temperature in a range of 85° C. to 105° C. It is preferable that the wet-heat treatment is carried out by water vapor (steam). If the wet-heat treatment is carried out at a temperature higher than 80° C., the voids that have disappeared due to the dyeing or discharge-printing treatment can be restored, and thus a lightweight and voluminous pile fabric can be obtained. Further, if the wet-heat treatment is carried out at a temperature lower than 120° C., the effect of restoring the voids is achieved, and further a pile fabric that has a smooth surface and a soft touch can be obtained. It is preferable that the wet-heat treatment is carried out for at least 30 minutes, and more preferably 30 minutes or more but not longer than 2 hours.

In the pile fabric of the present invention, the acrylic synthetic fiber to form the napped portion maintains its porosity even after being subjected to a dyeing or a discharge-printing treatment. This can be confirmed by observing with a scanning electron microscope (SEM) the cross section of the acrylic synthetic fiber forming the napped portion of the pile fabric.

EXAMPLES

Hereinafter, the present invention will be described in detail by way of Examples. However, the present invention is not limited to the following Examples.

Manufacturing Example 1

<Manufacture of Polymer A>

In a pressure-resistant polymerization reactor with a capacity of 20 L, 12000 g of ion-exchange water, 54 g of sodium lauryl sulfate, 25.8 g of sulfurous acid, 13.2 g of sodium hydrogen sulfite, 0.06 g of iron sulfate, 294 g of acrylonitrile (hereinafter, referred to as AN) and 3150 g of vinyl chloride (hereinafter, referred to as VC) were put and substituted with a nitrogen atmosphere. The temperature in the reactor was adjusted to 50° C., and 2.1 g of ammonium persulfate serving as an initiator was placed therein, thus starting polymerization. The polymerization was performed for 5 hours and 10 minutes while adding 2526 g of AN, 30 g of sodium styrenesulfonate (hereinafter, referred to as 3S) and 13.8 g of ammonium persulfate. Thereafter, unreacted VC was collected, and latex was cleared from the reactor, followed by salting out, heat treatment, filtering, washing with water, dewatering and drying, thus obtaining a polymer 1. That is, the polymer 1 was formed by polymerizing a composition composed of 50 wt % of acrylonitrile, 49.5 wt % of vinyl chloride and 0.5 wt % of sodium styrenesulfonate.

Manufacturing Example 2

<Manufacture of Polymer B>

In a pressure-resistant polymerization reactor with a capacity of 5 L, 1400 g of acetone, 930 g of water, 150 g of AN, 540 g of methyl acrylate (hereinafter, referred to as MA), 300 g of sodium 2-acrylamido-2-methylpropanesulfonate (hereinafter, referred to as SAM) and 10 g of sodium methallylsulfonate (hereinafter, referred to as MX) were put and substituted with a nitrogen atmosphere. The temperature in the reactor was adjusted to 55° C., and 5 g of 2,2'-azobis (2,4-dimethylvaleronitrile) serving as an initiator was placed therein, thus starting polymerization. The polymerization was performed for 16 hours while adding 10 g of 2,2'-azobis (2,4-dimethylvaleronitrile), followed by heating to 70° C. and polymerization for 6 hours, thus obtaining a solution of a polymer 2 having a polymer concentration of 30 wt %. That is, the polymer 2 was formed by polymerizing a composition composed of 15 wt % of acrylonitrile, 54 wt % of methyl acrylate, 30 wt % of sodium 2-acrylamido-2-methylpropanesulfonate, and 1.0 wt % of sodium methallylsulfonate.

According to the result of measurement as described below, the solubility of the polymer 2 was 10 wt % or more.

(Solubility)

Solubility at 40° C. with respect to a mixed solvent composed of 20 wt % of distilled water and 80 wt % of acetone was measured. Here, dissolution indicates that a polymer is mixed in a mixed solvent in a transparent and homogeneous state.

Working Example 1

<Manufacture of Acrylic Synthetic Fiber>

A spinning solution was prepared by mixing a solution of the polymer 2 in a solution of the polymer 1, in which the polymer 1 was dissolved in acetone so as to achieve 30 wt % polymer 1 concentration, such that the weight ratio of polymer 1 polymer 2=96:4. The resultant spinning solution was extruded through a rectangular spinneret (short axis length: 0.04 mm; long axis length: 0.24 mm) into a 30 wt % acetone aqueous solution at 25° C. and further drawn by 2.0 times in a 20 wt % acetone aqueous solution at 25° C., followed by washing with water at 60° C. Then, the fiber was dried at 130° C. and further drawn by 1.8 times at 110° C., thus obtaining drawn yarns. Subsequently, the resultant drawn yarns were provided with crimps and cut, and then shrunk by being subjected to a wet-heat treatment in 100° C. boiled water for 60 minutes, so that an acrylic synthetic fiber having a fineness of 7.8 dtex and a fiber length of 38 mm was obtained. Then, the resultant acrylic synthetic fiber was dyed. Specifically, with respect to 2000 g of the acrylic synthetic fiber, 10 L of water, 3.5 g of red cationic dye (trade name: "Aizen Cathilon Red CD-FGLH" manufactured by Hodogaya Chemical Co., Ltd.), 13.42 g of yellow cationic dye (trade name: "Aizen Cathilon Discharge Yellow NLH" manufactured by Hodogaya Chemical Co., Ltd.), and 1.08 g of blue cationic dye (trade name: "Astrazon Blue FGGL" manufactured by Dystar Japan Ltd.) were used to carry out the dyeing at 98° C. for 1 hour. After the dyeing, the acrylic synthetic fiber had an apparent specific gravity of 0.95.

<Manufacture of Pile Fabric>

By using a sliver knitting machine (circular knitting machine) for producing a fake fur, a pile fiber sliver composed of 100 wt % of the dyed acrylic synthetic fiber was fed to knit a pile fabric. Next, the back face of the resultant pile fabric was impregnated with a backing resin and dried. Next, the pile fibers on the surface of the pile fabric were arranged properly by polishing, brushing and shearing, thereby obtaining a high pile having a textile weight per length of 1000 g/m (weight per length of 1 m of pile fabric), and the fiber length at the napped portion of 25 mm. At that time, the apparent specific gravity of the acrylic synthetic fiber at the napped portion was 0.96. The width of the pile fabric was 1.55 m.

A discharge paste containing stannous chloride as a discharging agent was prepared. After applying the discharge paste on the surface (napped portion) of the resultant pile fabric, a steaming treatment was performed at 100° C. for 30 minutes. After that, excessive discharge paste was washed out with water, and the pile fabric was dried with hot air at about 60° C.

After the above-described discharging step, a print dyestuff was applied on the surface of the pile fabric, and a steaming treatment was performed at 100° C. for 30 minutes so as to dye the fiber at the napped portion with the print dyestuff. The acrylic synthetic fiber at the napped portion after the printing step had an apparent specific gravity of 1.20. For the print dyestuff, Maxilon Golden Yellow GL (manufactured by Ciba Specialty Chemicals Inc.), Astrazon Brilliant Red 4G (manufactured by Miles (Mobay)) and Astrazon Blue F2RL (manufactured by Dystar Japan Ltd.) were used.

After a color discharge-printing treatment, water in an amount of 570 g per length of 1 m of the pile fabric was sprayed on the surface of the pile fabric so that the surface of the pile fabric would get wet uniformly. Next, a wet-heat treatment was performed for 30 minutes with steam of 100° C., and after drying at 60° C. for 2 hours, polishing and shearing were conducted. The acrylic synthetic fiber at the napped portion of the resultant pile fabric had an apparent specific gravity of 0.98. And the pile fiber after the polishing and shearing had a favorable touch.

Working Example 2

A pile fabric was obtained similarly to Working Example 1 except that the amount of water to be sprayed on the surface of the pile fabric was set to 850 g per length of 1 m of the pile fabric. The fiber at the napped portion of the resultant pile fabric had an apparent specific gravity of 0.95. And the pile fiber after the polishing and shearing had a favorable touch.

Working Example 3

A pile fabric was obtained similarly to Working Example 1 except that the amount of water to be sprayed on the surface of the pile fabric was set to 1500 g per length of 1 m of the pile fabric. The fiber at the napped portion of the resultant pile fabric had an apparent specific gravity of 0.94. And the pile fiber after the polishing and shearing had a favorable touch.

Working Example 4

A pile fabric was obtained similarly to Working Example 1 except that the textile weight per length of the pile fabric (high pile) was set to 1200 g/m and that the amount of water to be sprayed on the surface of the pile fabric was set to 703 g per length of 1 m of the pile fabric. The fiber at the napped portion of the resultant pile fabric had an apparent specific gravity of 0.98. And the pile fiber after the polishing and shearing had a favorable touch.

Working Example 5

A pile fabric was obtained similarly to Working Example 1 except that the wet-heat treatment after the color discharge-printing treatment was carried out with a high-pressure steam at 120° C. The fiber at the napped portion of the resultant pile fabric had an apparent specific gravity of 0.90. However, the napped portion of the pile fabric was damaged by the high temperature steam and the fibers at the napped portion shrunk, causing a rough touch of the pile fabric.

Working Example 6

<Manufacture of Acrylic Synthetic Fiber>

A spinning solution was prepared by mixing a solution of the polymer 2 in a solution of the polymer 1, in which the polymer 1 was dissolved in acetone so as to achieve 30 wt % polymer 1 concentration, such that the weight ratio of polymer 1 polymer 2=94:6. The resultant spinning solution was extruded through a circular spinneret (ϕ0.08 mm) into a 30 wt % acetone aqueous solution at 25° C. and further drawn by 2.0 times in a 20 wt % acetone aqueous solution at 25° C., followed by washing with water at 60° C. Then, the fibers were dried at 130° C. and further drawn by 1.8 times at 110° C., thus obtaining a drawn yarn. Subsequently, the resultant drawn yarn was provided with crimps and cut, from which a worsted yarn was produced. The yarn was shrunk by a wet-heat treatment in 100° C. boiled water for 60 minutes, so that a worsted yarn of an acrylic synthetic fiber having a fineness of 3.3 dtex and a fiber length of 102 mm was obtained.

Then, the resultant worsted yarn of an acrylic synthetic fiber was dyed. Specifically, with respect to 2000 g of the worsted yarn, 10 L of water, 3.5 g of red cationic dye (trade name: "Aizen Cathilon Red CD-FGLH" manufactured by Hodogaya Chemical Co., Ltd.), 13.42 g of yellow cationic dye (trade name: "Aizen Cathilon Discharge Yellow NLH" manufactured by Hodogaya Chemical Co., Ltd.), and 1.08 g of blue cationic dye (trade name: "Astrazon Blue FGGL" manufactured by Dystar Japan Ltd.) were used to carry out dyeing at 98° C. for 1 hour. At this point of time, the reeled thread had an apparent specific gravity of 0.98.

<Manufacture of Pile Fabric>

By using a bore-knitting machine (circular knitting machine) for producing a fake fur, the worsted yarn formed of the dyed acrylic synthetic fiber was fed to knit a pile fabric. Next, the back face of the resultant pile fabric was impregnated with a backing resin and then dried. Next, the pile fiber on the surface of the pile fabric was arranged properly by polishing, brushing and shearing, thereby obtaining a boa pile having a textile weight per length of 1200 g/m (weight per length of 1 m of pile fabric), and the fiber length at the napped portion of 25 mm. At that time, the apparent specific gravity of the acrylic synthetic fiber at the napped portion was 0.96. The width of the pile fabric was 1.55 m.

The discharging step and the printing step were carried out similarly to Example 1. After the printing step, the acrylic synthetic fiber at the napped portion had an apparent specific gravity of 1.20.

After a color discharge-printing treatment, water in an amount of 703 g per length of 1 m of the pile fabric was sprayed on the surface of the pile fabric so that the surface of the pile fabric would get wet uniformly. Next, a wet-heat treatment was performed for 30 minutes with a steam of 100° C., and after drying at 60° C. for 2 hours, polishing and shearing were conducted. The acrylic synthetic fiber at the napped portion of the resultant pile fabric had an apparent specific gravity of 0.96. And the pile fiber after the polishing and shearing had a favorable touch.

Working Example 7

A pile fabric was obtained similarly to Working Example 6 except that the amount of water to be sprayed on the surface of the pile fabric was set to 1050 g per length of 1 m of the pile fabric. The acrylic synthetic fiber at the napped portion of the resultant pile fabric had an apparent specific gravity of 0.95. And the pile fiber after the polishing and shearing had a favorable touch.

Working Example 8

A pile fabric was obtained similarly to Working Example 6 except that the amount of water to be sprayed on the surface of the pile fabric was set to 1850 g per length of 1 m of the pile fabric. The acrylic synthetic fiber at the napped portion of the resultant pile fabric had an apparent specific gravity of 0.94. And the pile fiber after the polishing and shearing had a favorable touch.

Working Example 9

A pile fabric was obtained similarly to Working Example 6 except that the textile weight per length of the pile fabric (boa pile) was set to 1450 g/m and that the amount of water to be sprayed on the surface of the pile fabric was set to 870 g per length of 1 m of the pile fabric. The acrylic synthetic fiber at the napped portion of the resultant pile fabric had an apparent specific gravity of 0.96. And the pile fiber after the polishing and shearing had a favorable touch.

Working Example 10

A pile fabric was obtained similarly to Working Example 6 except that the wet-heat treatment after a color discharge-printing treatment was carried out with a high-pressure steam at 120° C. The acrylic synthetic fiber at the napped portion of the resultant pile fabric had an apparent specific gravity of 0.92. However, the napped portion of the pile fabric was damaged by the high temperature steam and the fibers at the napped portion shrunk, causing a rough touch of the pile fabric.

Comparative Example 1

A pile fabric (high pile) was obtained similarly to Working Example 1 except that water was not sprayed on the surface of the pile fabric after the color discharge-printing treatment. The acrylic synthetic fiber at the napped portion of the resultant pile fabric had an apparent specific gravity of 1.22.

Comparative Example 2

A pile fabric was obtained similarly to Working Example 1 except that the amount of water to be sprayed on the surface of the pile fabric was set to 130 g per length of 1 m of the pile fabric. The acrylic synthetic fiber at the napped portion of the resultant pile fabric had an apparent specific gravity of 1.18.

Comparative Example 3

A pile fabric was obtained similarly to Working Example 1 except that the amount of water to be sprayed on the surface of the pile fabric was set to 360 g per length of 1 m of the pile fabric. The acrylic synthetic fiber at the napped portion of the resultant pile fabric had an apparent specific gravity of 1.15.

Comparative Example 4

A pile fabric was obtained similarly to Working Example 1 except that the steam temperature in the wet-heat treatment after the color discharge-printing treatment was set to 80° C. The acrylic synthetic fiber at the napped portion of the resultant pile fabric had an apparent specific gravity of 1.18.

Comparative Example 5

A pile fabric was obtained similarly to Working Example 1 except that a hot air treatment was carried out at 100° C. for 30 minutes (dry-heat treatment) in place of the wet-heat treatment after the color discharge-printing treatment. The acrylic synthetic fiber at the napped portion of the resultant pile fabric had an apparent specific gravity of 1.20.

Comparative Example 6

A pile fabric (boa pile) was obtained similarly to Working Example 6 except that water was not sprayed on the surface of the pile fabric after the color discharge-printing treatment. The acrylic synthetic fiber at the napped portion of the resultant pile fabric had an apparent specific gravity of 1.22.

Comparative Example 7

A pile fabric was obtained similarly to Working Example 6 except that the amount of water to be sprayed on the surface of the pile fabric was set to 160 g per length of 1 m of the pile fabric. The acrylic synthetic fiber at the napped portion of the resultant pile fabric had an apparent specific gravity of 1.18.

Comparative Example 8

A pile fabric was obtained similarly to Working Example 6 except that the amount of water to be sprayed on the surface of the pile fabric was set to 450 g per length of 1 m of the pile fabric. The acrylic synthetic fiber at the napped portion of the resultant pile fabric had an apparent specific gravity of 1.15.

Comparative Example 9

A pile fabric was obtained similarly to Working Example 6 except that the steam temperature in the wet-heat treatment after the color discharge-printing treatment was set to 80° C. The acrylic synthetic fiber at the napped portion of the resultant pile fabric had an apparent specific gravity of 1.18.

Comparative Example 10

A pile fabric was obtained similarly to Working Example 6 except that a hot air treatment was carried out at 100° C.

for 30 minutes (dry-heat treatment) in place of the wet-heat treatment after the color discharge-printing treatment. The acrylic synthetic fiber at the napped portion of the resultant pile fabric had an apparent specific gravity of 1.20.

The apparent specific gravities of the acrylic synthetic fibers in the respective stages in manufacturing the pile fabrics in Working Examples and Comparative Examples were measured as described below and the results are illustrated in Tables 1 to 4 below. Further, the textures and the voluminousnesses of the pile fabrics in Working Examples and Comparative Examples were evaluated as described below and the results are illustrated in Tables 1 to 4 below.

(Apparent Specific Gravity)

The apparent specific gravity was measured using an automatic densimeter (DENSIMETER-H) manufactured by Ibyo Seiki Seisaku-sho Ltd.

(Texture of Pile Fabric)

The texture of each pile fabric was subjected to a sensory evaluation on a 1-to-2 scale as described below, based on the touch of the pile fabric:

A: the surface of the pile fabric is smooth, providing a soft touch;

B: the surface of the pile fabric is rough, providing a hard touch.

(Voluminousness of Pile Fabric)

The voluminousness was evaluated by comparing the pile fabrics manufactured in Working Examples and Comparative Examples with a pile fabric formed of an existing fiber (Kanekaron All manufactured by Kaneka Corporation) in light of the perceived density in appearance and bulkiness in touch. Specifically, the comparative evaluation was a sensory evaluation on a 1-to-2 scale as described below:

A; both the perceived density in appearance and the bulkiness in touch are higher in comparison with a pile fabric formed of an existing fiber; and B: both the perceived density in appearance and the bulkiness in touch are substantially equivalent to those of a pile fabric formed of an existing fiber.

TABLE 1

| | Working Example 1 | Working Example 2 | Working Example 3 | Working Example 4 | Working Example 5 |
|---|---|---|---|---|---|
| Pile fabric weight per length (g/m) | 1000 | 1000 | 1000 | 1200 | 1000 |
| Weight of napped portion (g/m) | 850 | 850 | 850 | 1050 | 850 |
| Addition amount of water (g/m) | 570 | 850 | 1500 | 703 | 570 |
| Ratio of addition amount of water to weight of napped portion (wt %) | 67 | 100 | 176 | 67 | 67 |
| Apparent specific gravity before discharge-printing treatment | 0.96 | 0.96 | 0.96 | 0.96 | 0.96 |
| Apparent specific gravity after discharge-printing treatment | 1.20 | 1.20 | 1.20 | 1.20 | 1.20 |
| Apparent specific gravity after water addition - wet-heat treatment | 0.98 | 0.95 | 0.94 | 0.98 | 0.90 |
| Temperature of wet-heat treatment (° C.) | 100 | 100 | 100 | 100 | 120 |
| Voluminousness | A | A | A | A | A |
| Texture | A | A | A | A | B |

TABLE 2

| | Working Example 6 | Working Example 7 | Working Example 8 | Working Example 9 | Working Example 10 |
|---|---|---|---|---|---|
| Pile fabric weight per length (g/m) | 1200 | 1200 | 1200 | 1450 | 1200 |
| Weight of napped portion (g/m) | 1050 | 1050 | 1050 | 1300 | 1050 |
| Addition amount of water (g/m) | 703 | 1050 | 1850 | 870 | 703 |
| Ratio of addition amount of water to weight of napped portion (wt %) | 67 | 100 | 176 | 67 | 67 |
| Apparent specific gravity before discharge-printing treatment | 0.96 | 0.96 | 0.96 | 0.96 | 0.96 |
| Apparent specific gravity after discharge-printing treatment | 1.20 | 1.20 | 1.20 | 1.20 | 1.20 |
| Apparent specific gravity after water addition - wet-heat treatment | 0.96 | 0.95 | 0.94 | 0.96 | 0.92 |
| Temperature of wet-heat treatment (° C.) | 100 | 100 | 100 | 100 | 120 |
| Voluminousness | A | A | A | A | A |
| Texture | A | A | A | A | B |

TABLE 3

| | Comparative Example 1 | Comparative Example 2 | Comparative Example 3 | Comparative Example 4 | Comparative Example 5 |
|---|---|---|---|---|---|
| Pile fabric weight per length (g/m) | 1000 | 1000 | 1000 | 1000 | 1000 |
| Weight of napped portion (g/m) | 850 | 850 | 850 | 850 | 850 |
| Addition amount of water (g/m) | 0 | 130 | 360 | 570 | 570 |
| Ratio of addition amount of water to weight of napped portion (wt %) | 0 | 15 | 42 | 67 | 67 |
| Apparent specific gravity before discharge-printing treatment | 0.96 | 0.96 | 0.96 | 0.96 | 0.96 |
| Apparent specific gravity after discharge-printing treatment | 1.20 | 1.20 | 1.20 | 1.20 | 1.20 |
| Apparent specific gravity after water addition - wet-heat treatment | 1.22 | 1.18 | 1.15 | 1.18 | 1.20 |
| Temperature of wet-heat treatment (° C.) | 100 | 100 | 100 | 80 | Dry-heat treatment |
| Voluminousness | B | B | B | B | B |
| Texture | A | A | A | A | A |

TABLE 4

| | Comparative Example 6 | Comparative Example 7 | Comparative Example 8 | Comparative Example 9 | Comparative Example 10 |
|---|---|---|---|---|---|
| Pile fabric weight per length (g/m) | 1200 | 1200 | 1200 | 1200 | 1200 |
| Weight of napped portion (g/m) | 1050 | 1050 | 1050 | 1050 | 1050 |
| Addition amount of water (g/m) | 0 | 160 | 450 | 703 | 703 |
| Ratio of addition amount of water to weight of napped portion (wt %) | 0 | 15 | 43 | 67 | 67 |
| Apparent specific gravity before discharge-printing treatment | 0.96 | 0.96 | 0.96 | 0.96 | 0.96 |
| Apparent specific gravity after discharge-printing treatment | 1.20 | 1.20 | 1.20 | 1.20 | 1.20 |
| Apparent specific gravity after water addition - wet-heat treatment | 1.22 | 1.18 | 1.15 | 1.18 | 1.20 |
| Temperature of wet-heat treatment (° C.) | 100 | 100 | 100 | 80 | Dry-heat treatment |
| Voluminousness | B | B | B | B | B |
| Texture | A | A | A | A | A |

Figure 3A:
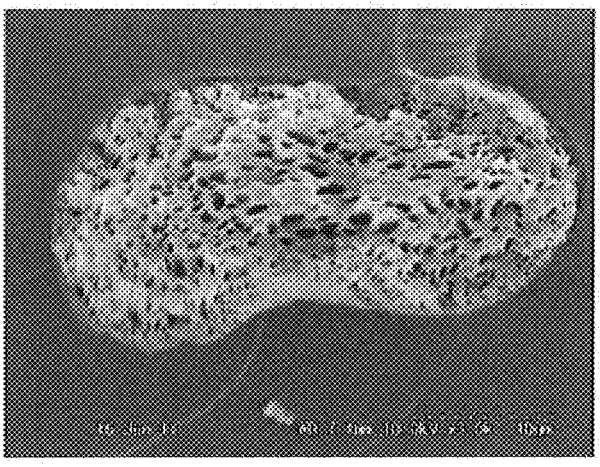
FIG. 3A is a photograph taken with a scanning electron microscope (SEM) to show a cross section of an acrylic synthetic fiber before discharge-printing in Working Example 1.
Figure 3B:
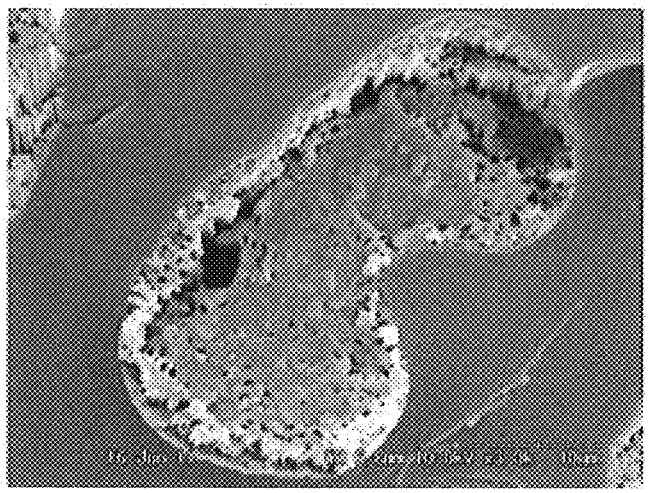
FIG. 3B is a photograph taken with a scanning electron microscope (SEM) to show a cross section of an acrylic synthetic fiber after discharge-printing in Working Example 1.
Figure 3C:
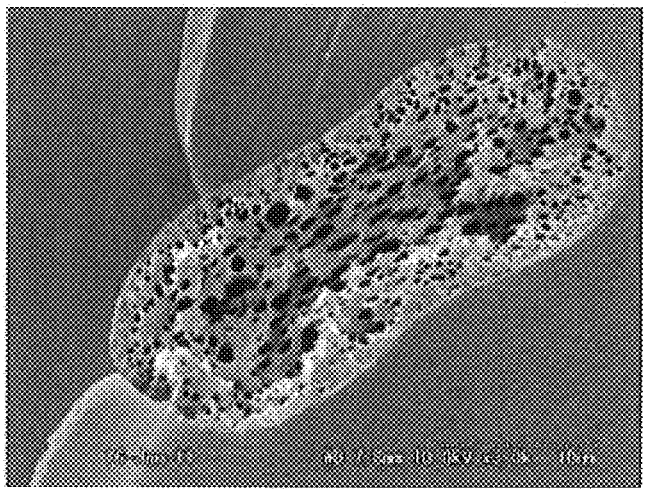
FIG. 3C is a photograph taken with a scanning electron microscope (SEM) to show a cross section of an acrylic synthetic fiber after water addition and a wet-heat treatment in Working Example 1.

As is evident from the results in the above Tables 1 to 4, in the pile fabrics of Working Examples, the discharge-printed acrylic synthetic fibers at the napped portions had apparent specific gravities in the range of 0.8 to 1.1, namely they had excellent lightness and voluminousness. In particular, in Working Examples 1-4 and 6-9 where the temperature of the wet-heat treatment after a discharge-printing treatment was lower than 120° C., the texture also was excellent. Further, the pile fabrics of Working Examples exhibited different colors between the tops and the roots, rendering an excellent design. And as shown in FIG. 1, it was confirmed in Working Example 1 that the acrylic synthetic fiber that was subjected to water addition and a wet-heat treatment after a discharge-printing treatment maintained its porosity. Though not shown in the attached drawings, it was confirmed that similarly in any of the other Working Examples, the acrylic synthetic fiber subjected to water addition and a wet-heat treatment after a discharge-printing treatment maintained its porosity. As shown in FIGS. 3A-3C, in the acrylic synthetic fiber that forms the napped portion of the pile fabric in Working Example 1, the voids that had disappeared due to the discharge-printing treatment were restored as a result of the water addition and the wet-heat treatment. Furthermore, in Working Examples 5 and 10 where the wet-heat treatment was carried out at 120° C., the texture of the resultant pile fabric was inferior to that in a case of wet-heat treatment at 100° C., but the apparent specific gravity reached the range of 0.8 to 1.1, and the pile fabrics had excellent lightness and voluminousness.

Figure 2:
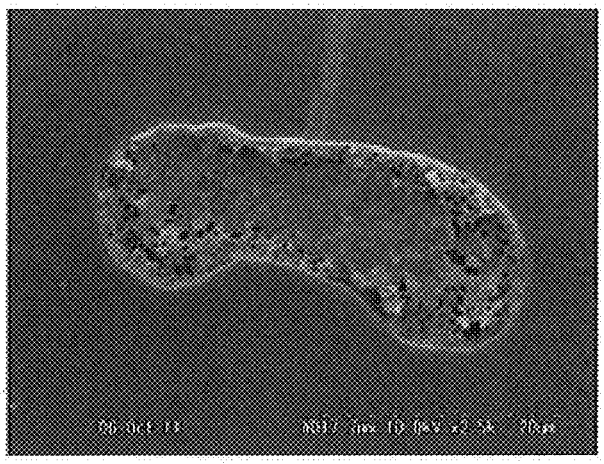
FIG. 2 is a photograph taken with a scanning electron microscope (SEM) to show a cross section of an acrylic synthetic fiber in a pile fabric of Comparative Example 5.

On the other hand, in Comparative Examples 1-3 and 6-8, no water was added or the addition amount of the water was not more than 43 parts by weight with respect to 100 parts by weight of the discharge-printed acrylic synthetic fiber that forms the napped portion (weight of napped portion). In all of these Comparative Examples, the apparent specific gravity of the discharge-printed acrylic synthetic fiber at the napped portion exceeded 1.1, and the pile fabric lacked voluminousness. In Comparative Examples 4 and 9 where the temperature of the wet-heat treatment after the discharge-printing treatment was 80° C. and in Comparative Examples 5 and 10 where a dry-heat treatment was carried out in place of the wet-heat treatment, the apparent specific gravity of the discharge-printed acrylic synthetic fiber at the napped portion exceeded 1.1, and the pile fabric lacked voluminousness. Further, as shown in FIG. 2, in Comparative Example 5, it was confirmed that the voids disappeared in the acrylic synthetic fiber that had been subjected to water addition and a dry-heat treatment after a discharge-printing treatment. Though not shown in the attached drawings, in the other Comparative Examples, it was confirmed that the voids disappeared similarly in the acrylic synthetic fiber that had been subjected to either water addition and a wet-heat treatment or water addition and a dry-heat treatment, after a discharge-printing treatment.

The invention claimed is:

1. A method for manufacturing a pile fabric comprising an acrylic synthetic fiber at a napped portion of a pile fabric, wherein the acrylic synthetic fiber is a fiber obtained by spinning a spinning solution comprising a polymer A and a polymer B; the polymer A is 90 to 99 parts by weight and the polymer B is 1 to 10 parts by weight when the total weight of the polymer A and the polymer B in the spinning solution is 100 parts by weight; the polymer A is a polymer obtained by polymerizing a composition A that is a composition comprising 40 to 97 wt % of acrylonitrile, 0 to 5 wt % of sulfonic acid-containing monomer and 3 to 60 wt % of another copolymerizable monomer when the total weight of the composition A is 100 wt %; the polymer B is a polymer that is obtained by polymerizing a composition B and that is dissolved in a mixed solvent comprising water and at least one organic solvent selected from the group consisting of N,N-dimethylformamide, N,N-dimethylacetamide, dimethylsulfoxide and acetone; and the composition B is a composition comprising 0 to 70 wt % of acrylonitrile, 20 to 90 wt % of acrylic ester and 10 to 40 wt % of sulfonic acid-containing monomer when the total weight of the composition B is 100 wt %, the method comprising:

dyeing at least partially the acrylic synthetic fiber before forming the napped portion of the pile fabric or after forming the napped portion of the pile fabric to make a dyed acrylic synthetic fiber;

discharge-printing the pile fabric comprising the dyed acrylic synthetic fiber at the napped portion to make a discharge-printed acrylic synthetic fiber at the napped portion of the pile fabric; and separately from the discharge-printing, adding water to the dyed acrylic synthetic fiber or the discharge-printed acrylic synthetic fiber at the napped portion of the pile fabric in an amount of more than 43 parts by weight with respect to 100 parts by weight of the dyed acrylic synthetic fiber or the discharge-printed acrylic synthetic fiber at the napped portion of the pile fabric, and carrying out a wet-heat treatment at a temperature higher than 80° C., wherein, after the adding water step, the dyed acrylic synthetic fiber or the discharge-printed acrylic synthetic fiber at the napped portion of the pile fabric has an apparent specific gravity in a range of 0.8 to 1.1.

2. The method for manufacturing the pile fabric according to claim 1, wherein the polymer B is a polymer that is dissolved at a concentration of 1 wt % or more in a mixed solvent composed of 20 wt% of distilled water and 80 wt % of at least one organic solvent selected from the group consisting of N,N-dimethylformamide, N,N-dimethylacetamide, dimethylsulfoxide and acetone when the total weight of the mixed solvent is 100 wt % at 40° C.

3. The method for manufacturing the pile fabric according to claim 1, wherein the discharge-printing treatment comprises a discharging step and/or a printing step.

4. The method for manufacturing the pile fabric according to claim 1, wherein the wet-heat treatment is carried out at a temperature of 85° C. or higher and lower than 120° C.

5. The method for manufacturing the pile fabric according to claim 1, wherein the water is added in an amount of 60 parts by weight or more and 200 parts by weight or less with respect to 100 parts by weight of the acrylic synthetic fiber forming the napped portion of the pile fabric.

6. The method for manufacturing the pile fabric according to claim 1, wherein the wet-heat treatment is carried out for 30 minutes or more and 2 hours or less.

7. The method for manufacturing the pile fabric according to claim 2, wherein the discharge-printing treatment comprises a discharging step and/or a printing step.

8. The method for manufacturing the pile fabric according to claim 2, wherein the wet-heat treatment is carried out at a temperature of 85° C. or higher and lower than 120° C.

9. The method for manufacturing the pile fabric according to claim 3, wherein the wet-heat treatment is carried out at a temperature of 85° C. or higher and lower than 120° C.

10. The method for manufacturing the pile fabric according to claim 2, wherein the water is added in an amount of 60 parts by weight or more and 200 parts by weight or less with respect to 100 parts by weight of the acrylic synthetic fiber forming the napped portion of the pile fabric.

11. The method for manufacturing the pile fabric according to claim 3, wherein the water is added in an amount of 60 parts by weight or more and 200 parts by weight or less with respect to 100 parts by weight of the acrylic synthetic fiber forming the napped portion of the pile fabric.

12. The method for manufacturing the pile fabric according to claim 4, wherein the water is added in an amount of 60 parts by weight or more and 200 parts by weight or less with respect to 100 parts by weight of the acrylic synthetic fiber forming the napped portion of the pile fabric.

13. The method for manufacturing the pile fabric according to claim 2, wherein the wet-heat treatment is carried out for 30 minutes or more and 2 hours or less.

14. The method for manufacturing the pile fabric according to claim 3, wherein the wet-heat treatment is carried out for 30 minutes or more and 2 hours or less.

15. The method for manufacturing the pile fabric according to claim 4, wherein the wet-heat treatment is carried out for 30 minutes or more and 2 hours or less.

16. The method for manufacturing the pile fabric according to claim 5, wherein the wet-heat treatment is carried out for 30 minutes or more and 2 hours or less.

17. The method for manufacturing the pile fabric according to claim 1, wherein the composition A comprises 40 to 70 wt % of acrylonitrile, 0 to 5 wt % of sulfonic acid-containing monomer and 30 to 60 wt % of another copolymerizable monomer when the total weight of the composition A is 100 wt %.

18. The method for manufacturing the pile fabric according to claim 1, wherein the other copolymerizable monomer is a halogen-containing monomer.

19. The method according to claim 1, wherein the discharge-printing treatment comprises a discharging step, the discharging step being carried out by applying a discharge paste including a discharging agent on the surface of the pile fabric and steaming the discharge past on the surface of the pile fabric.

20. The method according to claim 19, wherein the wet-heat treatment is carried out by water vapor.

21. The method according to claim 1, wherein the wet-heat treatment is carried out by water vapor.

22. A method for manufacturing a pile fabric comprising an acrylic synthetic fiber at a napped portion of a pile fabric, wherein the acrylic synthetic fiber is a fiber obtained by spinning a spinning solution comprising a polymer A and a polymer B; the polymer A is 90 to 99 parts by weight and the polymer B is 1 to 10 parts by weight when the total weight of the polymer A and the polymer B in the spinning solution is 100 parts by weight; the polymer A is a polymer obtained by polymerizing a composition A that is a composition comprising 40 to 97 wt % of acrylonitrile, 0 to 5 wt % of sulfonic acid-containing monomer and 3 to 60 wt % of another copolymerizable monomer when the total weight of the composition A is 100 wt %; the polymer B is a polymer that is obtained by polymerizing a composition B and that is dissolved in a mixed solvent comprising water and at least one organic solvent selected from the group consisting of N,N-dimethylformamide, N,N-dimethylacetamide, dimethylsulfoxide and acetone; and the composition B is a composition comprising 0 to 70 wt % of acrylonitrile, 20 to 90 wt % of acrylic ester and 10 to 40 wt % of sulfonic acid-containing monomer when the total weight of the composition B is 100 wt %, the method comprising:

dyeing at least partially the acrylic synthetic fiber before forming the napped portion of the pile fabric or after forming the napped portion of the pile fabric to make a dyed acrylic synthetic fiber; and adding water to the dyed acrylic synthetic fiber in an amount of more than 43 parts by weight with respect to 100 parts by weight of the dyed acrylic synthetic fiber forming the napped portion of the pile fabric, and carrying out a wet-heat treatment at a temperature higher than 80° C., wherein, after the adding water step, the dyed acrylic synthetic fiber has an apparent specific gravity in a range of 0.8 to 1.1.

23. The method for manufacturing the pile fabric according to claim 22, wherein the polymer B is a polymer that is dissolved at a concentration of 1 wt % or more in a mixed solvent composed of 20 wt % of distilled water and 80 wt % of at least one organic solvent selected from the group consisting of N,N-dimethylformamide, N,N-dimethylacetamide, dimethylsulfoxide and acetone when the total weight of the mixed solvent is 100 wt % at 40° C.

24. The method for manufacturing the pile fabric according to claim 23, wherein the wet-heat treatment is carried out for 30 minutes or more and 2 hours or less.

25. The method for manufacturing the pile fabric according to claim 23, wherein the wet-heat treatment is carried out at a temperature of 85° C. or higher and lower than 120° C.

26. The method for manufacturing the pile fabric according to claim 23, wherein the water is added in an amount of 60 parts by weight or more and 200 parts by weight or less with respect to 100 parts by weight of the acrylic synthetic fiber forming the napped portion of the pile fabric.

27. The method for manufacturing the pile fabric according to claim 22, wherein the wet-heat treatment is carried out at a temperature of 85° C. or higher and lower than 120° C.

28. The method for manufacturing the pile fabric according to claim 27, wherein the water is added in an amount of 60 parts by weight or more and 200 parts by weight or less with respect to 100 parts by weight of the acrylic synthetic fiber forming the napped portion of the pile fabric.

29. The method for manufacturing the pile fabric according to claim 27, wherein the wet-heat treatment is carried out for 30 minutes or more and 2 hours or less.

30. The method for manufacturing the pile fabric according to claim 22, wherein the water is added in an amount of 60 parts by weight or more and 200 parts by weight or less with respect to 100 parts by weight of the acrylic synthetic fiber forming the napped portion of the pile fabric.

31. The method for manufacturing the pile fabric according to claim 30, wherein the wet-heat treatment is carried out for 30 minutes or more and 2 hours or less.

32. The method for manufacturing the pile fabric according to claim 22, wherein the wet-heat treatment is carried out for 30 minutes or more and 2 hours or less.

33. The method for manufacturing the pile fabric according to claim 22, wherein the composition A comprises 40 to 70 wt % of acrylonitrile, 0 to 5 wt % of sulfonic acid-containing monomer and 30 to 60 wt % of another copolymerizable monomer when the total weight of the composition A is 100 wt %.

34. The method for manufacturing the pile fabric according to claim 22, wherein the other copolymerizable monomer is a halogen-containing monomer.

35. The method according to claim 22, wherein the discharge-printing treatment comprises a discharging step, the discharging step being carried out by applying a discharge paste including a discharging agent on the surface of the pile fabric and steaming the discharge past on the surface of the pile fabric.

36. The method according to claim 22, wherein the wet-heat treatment is carried out by water vapor.

* * * * *